US011699844B2

(12) United States Patent
Zhao

(10) Patent No.: US 11,699,844 B2
(45) Date of Patent: Jul. 11, 2023

(54) ANTENNA STRUCTURE AND WEARABLE DEVICE

(71) Applicant: Anhui Huami Information Technology Co., Ltd., Anhui FTZ (CN)

(72) Inventor: Anping Zhao, Anhui FTZ (CN)

(73) Assignee: Anhui Huami Information Technology Co., Ltd., Anhui FTZ (CN)

( * ) Notice: Subject to any disclaimer, the term of this patent is extended or adjusted under 35 U.S.C. 154(b) by 0 days.

(21) Appl. No.: 17/954,074

(22) Filed: Sep. 27, 2022

(65) Prior Publication Data

US 2023/0022192 A1 Jan. 26, 2023

Related U.S. Application Data

(63) Continuation of application No. PCT/CN2021/098121, filed on Jun. 3, 2021.

(30) Foreign Application Priority Data

Jun. 10, 2020 (CN) ..... 202010525769.0
Jun. 10, 2020 (CN) ..... 202021058390.5

(51) Int. Cl.
*H01Q 1/27* (2006.01)
*H01Q 5/30* (2015.01)
*H01Q 1/48* (2006.01)

(52) U.S. Cl.
CPC ..... *H01Q 1/273* (2013.01); *H01Q 1/48* (2013.01); *H01Q 5/30* (2015.01)

(58) Field of Classification Search
CPC ..... H01Q 1/241–243; H01Q 1/273; H01Q 1/38–52; H01Q 5/30–50; H01Q 13/10
See application file for complete search history.

(56) References Cited

U.S. PATENT DOCUMENTS 9,379,445 B2 * 6/2016 Zhu ..... H01Q 1/2266
10,797,382 B2 * 10/2020 Wu ..... H01Q 1/2283
(Continued)

FOREIGN PATENT DOCUMENTS

CN 104538741 A 4/2015
CN 108666739 A 10/2018
(Continued)

OTHER PUBLICATIONS

International Search Report with English translation for International Application No. PCT/CN2021/098121 dated Aug. 12, 2021.

*Primary Examiner* — Hasan Islam
(74) *Attorney, Agent, or Firm* — Young Basile Hanlon & MacFarlane, P.C.

(57) ABSTRACT

Provided are electronic devices, an antenna structure and a wearable device. The wearable device includes a metal casing including a bottom casing and a side frame surrounding an edge of the bottom casing and integrally connected with the bottom casing, the antenna structure includes a slot in the side frame, and the slot has a first end and a second end opposite to the first end in the first direction. The first direction is the direction surrounding the edge of the bottom casing; the slot is provided with an opening at the first end, and the opening faces the side away from the bottom casing; in the first direction, length from the first end to the grounding end of the slot is ¼ of operating wavelength; and a feeding terminal is arranged between the first end and the grounding end of the slot, and is close to the grounding end.

20 Claims, 5 Drawing Sheets

(56) References Cited

U.S. PATENT DOCUMENTS

| | | | | |
|---|---|---|---|---|
| 2017/0365916 | A1 | 12/2017 | Wu et al. | |
| 2019/0260112 | A1* | 8/2019 | Azad | H01Q 9/42 |

FOREIGN PATENT DOCUMENTS

| | | | |
|---|---|---|---|
| CN | 108963433 | A | 12/2018 |
| CN | 110277630 | A | 9/2019 |

* cited by examiner

ANTENNA STRUCTURE AND WEARABLE DEVICE

CROSS-REFERENCE TO RELATED APPLICATION(S)

The present application is a continuation application of International PCT Application No. PCT/CN2021/098121, filed on Jun. 3, 2021, which claims priority to Chinese Patent Application Nos. 202021058390.5 and 202010525769.0, both filed Jun. 10, 2020, the entire contents of all of which are hereby incorporated by reference.

TECHNICAL FIELD

The present disclosure relates to the technical field of electronic devices, and in particular, to antenna structures and wearable devices.

BACKGROUND

With development of electronic devices, smart wearable devices are more and more popular with users because of their diverse functions. Taking a smart watch as an example, generally, in addition to the basic timing function, a smart watch also integrates many functions such as motion assistance, trajectory positioning, and connection with a smart terminal. To achieve these functions, a built-in antenna is required in the smart watch to receive and radiate signals. For example, a watch needs a Global Position System (GPS) positioning antenna to receive GPS signals, and for another example, a watch needs a Bluetooth® antenna to interact and communicate with a mobile phone.

With development of wearable devices, more and more smart watches have all-metal casings/housing. The all-metal casing means that both the bottom casing and middle frame of the watch are made of metal materials. In particular, the bottom casing and the metal middle frame can be integrally formed, or the bottom casing and the metal middle frame can be connected together by, for example, screws. A metal casing provides better protection, and greatly improves the appearance and the class of the watch. However, the all-metal casing also shields the built-in antenna of the watch, making antenna design difficult. Therefore, how to realize antenna design of the all-metal casing has become an important research direction.

SUMMARY

The implementations of the present disclosure provide antenna structures and wearable devices.

In a first aspect, implementations of the present disclosure provide an antenna structure applied to a wearable device, where the wearable device includes a metal casing, the metal casing includes a bottom casing and a side frame surrounding an edge of the bottom casing and integrally connected with the bottom casing, and the antenna structure includes: a slot in the side frame, where the slot has a first end and a second end located on opposite sides in a first direction, and the first direction is a direction around the edge of the bottom casing; the slot is provided with an opening at the first end, and the opening faces the side away from the bottom casing; and in the first direction, a length from the first end of the slot to a grounding end is ¼ of an operating wavelength of the antenna structure; and a feeding terminal arranged in the slot and located between the first end of the slot and the grounding end and near to the grounding end in the first direction.

In some implementations, a groove is formed on the outer sidewall of the second end of the slot, and the groove and the opening have a same shape on the surface of the outer sidewall.

In some implementations, the groove is a non-penetrating groove.

In some implementations, the slot is filled with an injection-molded structure that matches the slot in shape, and the injection-molded structure is a non-metallic material.

In some implementations, the antenna structure further includes: a first capacitor, disposed in the slot and located between the first end and the grounding end in the first direction, and two poles of the first capacitor are respectively connected to two sides of the slot in a width direction.

In some implementations, the first capacitor is close to the first end in the first direction.

In some implementations, in the first direction, a distance between the feeding terminal and the grounding end is a first length, a distance between the first end and the grounding end is a second length, and a ratio of the first length to the second length is 0.1 to 0.2.

In some implementations, the second end of the slot forms the grounding end.

In some implementations, the antenna structure further includes: an additional grounding end disposed in the slot and located between the first end and the second end in the first direction, where the additional grounding end separates the slot in the first direction into a first sub-slot and a second sub-slot, and the additional grounding end forms the grounding end.

In a second aspect, implementations of the present disclosure provide a wearable device, including the antenna structure according to any implementation of the first aspect.

In some implementations, a short range wireless (e.g., a Bluetooth® antenna) and a satellite positioning antenna are included, and the Bluetooth antenna and the satellite positioning antenna have the above-mentioned antenna structure and are respectively disposed on opposite sides of the side frame; a first slot of the Bluetooth antenna and a second slot of the satellite positioning antenna are symmetrical in shape, and a length from the first end to the ground end of the first slot is ¼ of an operating wavelength of the Bluetooth antenna, and a length from the first end to the grounding end of the second slot is ¼ of an operating wavelength of a satellite positioning antenna.

In some implementations, the wearable device is a smart watch or a smart wristband.

The antenna structure provided by some implementations of the present disclosure is applied to a wearable device. The wearable device includes an all-metal casing that is integrally connected, and the antenna structure includes a slot in the side frame, and the slot has a first end and a second end opposite to the first end in a first direction, the first direction is a direction surrounding the side frame, the slot is provided with an opening at the first end, and the opening faces the side away from the bottom casing, a feeding terminal is arranged between the first end of the slot and the grounding end, and is close to the grounding end. A slot antenna is formed by providing the slot in the side frame, which is suitable for an all-metal casing. The opening is provided at one end of the slot, such that the feeding terminal and the slot form a ¼ wavelength slot antenna, that is, the length of the slot in the first direction is ¼ of the operating wavelength, which greatly shortens the length of the slot. On one hand, the metal appearance is preserved to the greatest extent, and on the other hand, due to the smaller slot, the casing is more integrated, which is convenient to improve the dustproof and waterproof level of the device, and at the same time meets the requirement of miniaturized wearable devices.

For the antenna structure provided by the implementations of the present disclosure, the second end of the slot forms the grounding end, or an additional grounding end is provided in the slot to form the grounding end. Therefore, by adjusting the position of the additional grounding end, antennas of different wavelength may be realized, such as a Bluetooth antenna and a satellite positioning antenna. In the case where the casing includes multiple antenna slots, one or more additional grounding ends are used to construct antenna structures with different wavelengths in a situation that slots shape are identical, so that the appearance of the device is more integrated.

For the antenna structure provided by the implementations of the present disclosure, a groove is formed on the outer sidewall of the second end of the slot, and the groove is the same as the opening in shape on the surface of the outer sidewall, such that the appearance is more symmetrical and the user experience is improved. In addition, an injection molding structure of non-metallic materials is filled in the slot to seal the slot, so as to realize dustproof and waterproof of the device, and keep the appearance of the casing consistent, thereby improving the user experience.

The antenna structure provided by some implementations of the present disclosure further includes a first capacitor, two poles of the first capacitor are respectively connected to both sides of the slot in the width direction, and the first capacitor is located at one end close to the opening in the first direction. By arranging a capacitor in the slot, the effective electrical length of the slot is increased, that is, under the condition of the same operating frequency, the slot length required by the antenna is shorter, and the space occupied by the antenna structure is further reduced.

For the antenna structure provided by some implementations of the present disclosure, in the first direction, the ratio of the distance between the feeding terminal and the grounding end to the distance between the first end and the grounding end is 0.1 to 0.2, such that the feeding terminal is closer to the grounding end, enabling the most effective using of the slot length. In addition, the return loss (or matching degree) of the antenna can be optimized by adjusting the distance between the feeding terminal and the grounding end. When the feeding terminal is located close to the grounding end, the matching of the antenna is most easily adjusted to the best, thereby improving the antenna performance.

The wearable device provided by the implementations of the present disclosure includes the antenna structure of any of the above-mentioned implementations, and thus has all the above-mentioned beneficial effects. And the device includes Bluetooth and satellite positioning antennas, and the two antennas can optionally be symmetrically arranged on opposite sides of the side frame, so as to maintain the symmetry of the device structure in appearance, to have a good appearance, and improve user experience.

BRIEF DESCRIPTION OF DRAWINGS

To describe the implementations of the present disclosure or solutions more clearly, a brief description of the drawings for the implementations of the present disclosure will be given below.

DETAILED DESCRIPTION

Figure 1A:
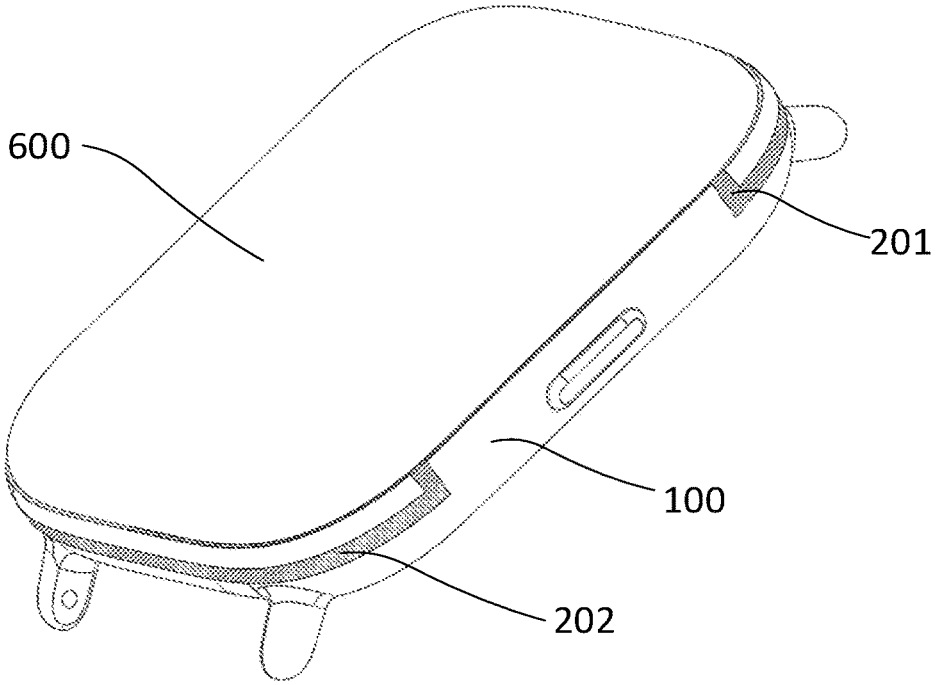
FIG. 1A is a schematic structural diagram of a wearable device according to some implementations of the present disclosure.

Technical solutions of the present disclosure will be clearly and completely described below with reference to accompanying drawings. Obviously, the described implementations are part of the implementations of the present disclosure, but not all of the implementations. Other implementations achieved by those of ordinary skill in the art based on the implementations in the present disclosure without paying creative work shall all fall within the scope of protection of the present disclosure. In addition, technical features involved in different implementations of the present disclosure described below can be combined with each other as long as they do not conflict with each other.

Antenna structures provided by the implementations of the present disclosure are applicable for wearable devices with all-metal casings. Smart wearable devices usually contain a variety of antennas, such as any combination of: short range wireless (e.g., Bluetooth®) antennas for establishing connections with smartphones, GPS antennas for positioning, and Long Term Evolution (LTE) antennas for communication with base stations. The smart devices radiate or receive signals through the antennas.

Taking a smart watch as an example, a smart watch can generally implement functions such as motion assistance and trajectory positioning, so the smart watch generally includes at least a Bluetooth antenna and a satellite positioning antenna. In an ordinary watch with a plastic casing, the built-in antenna can radiate and receive signals directly, and the antenna structure is easy to design. With the increase of metal material in a casing, the casing will shield electromagnetic signals, and how to design the antenna structure is becoming more difficult.

For example, the middle frame of some watches is made of metal, and the bottom casing is made of non-metallic materials such as plastic. In this case, the antenna can be realized through the gap between the metal middle frame and the main board, so that signals can be radiated outward through the upper and lower parts of the middle frame. When the watch has an all-metal casing, for example, the bottom casing and the middle frame of the watch casing are made of metal materials and are integrally formed, since the bottom casing is also made of metal, the antenna can no longer radiate signals through the gap between the main board and the middle frame, which makes the design of the built-in antenna more difficult.

In some instances, in order to realize the antenna structure for the all-metal casing, in some watches, an annular slot is provided in the middle of the middle frame, and the middle frame is divided into two independent parts, such that a slot antenna can be formed by the annular slot in the middle frame to radiate signals outward. In this slot antenna structure, the metal middle frame is completely divided, and non-metallic materials are filled in the annular slot to seal and form an integrated appearance, which greatly reduces the overall structural strength and dustproof and waterproof performance of the watch. In addition, the slot surrounds the watch, so even if the slot is injection-molded, the integrity of the watch is relatively poor, which makes the appearance of watch look bad and also reduce the class of the watch.

In order to solve the above-mentioned challenges, in a first aspect, some implementations of the present disclosure provide an antenna structure.

If the size of a device allows, the antenna structure according to the present disclosure can be used as various types of antennas in the device, such as a Bluetooth antenna, a GPS antenna, an LTE antenna, and the like. The wearable device involved in the present disclosure can also be any type of device suitable for implementation, such as wrist-worn devices (e.g. smart watches or smart wristbands), head-mounted devices (e.g. smart earphones or smart glasses), or worn devices (e.g. smart clothing), which is not limited in the present disclosure.

Figure 1B:
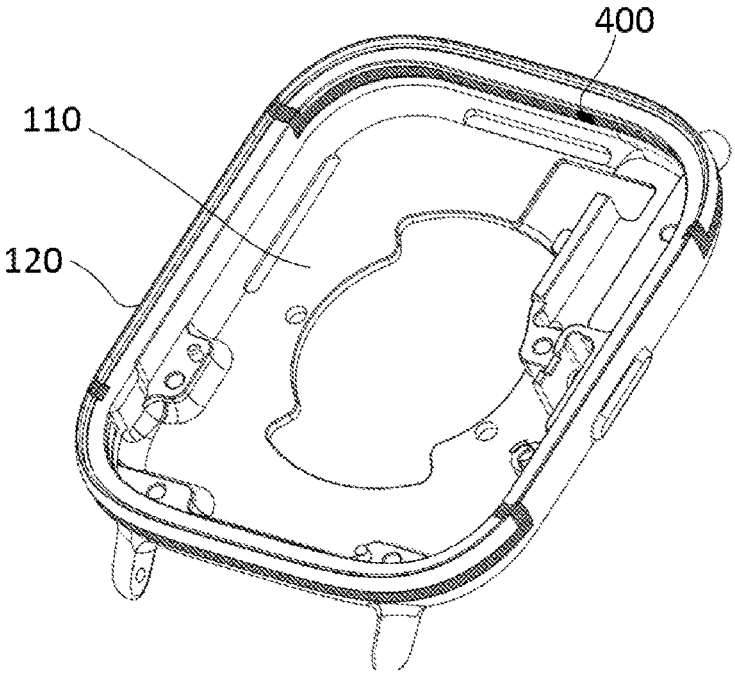
FIG. 1B is a schematic structural diagram of a casing of a wearable device according to some implementations of the present disclosure.

For the convenience of description, in the following implementations of the present disclosure, the wearable device is a smart watch as an example. As shown in FIG. 1A, the smart watch includes a casing 100 and a screen 600 disposed at the front opening of the casing 100. As shown in FIG. 1B, the casing 100 includes a bottom casing 110 and a side frame 120. The side frame 120 surrounds the edge of the bottom casing 110 to form a side middle frame. The bottom casing 110 and the side frame 120 are made of metal and are integrally formed. The structure of the casing in FIG. 1B is shown as an example, and in other implementations, there may also be metal casings of any other shape and structure. For example, the bottom casing 110 and the side frame 120 may also be fixedly connected by screws or the like. It should be understood by those skilled in the art that the present disclosure does not enumerate all possible connection manners of the bottom casing 110 and the side frame 120.

In some implementations, the antenna structure according to the present disclosure includes a slot in the side frame 120, the slot has a first end and an opposite second end in a first direction, and the first direction is a direction in which the side frame 120 surrounds the bottom casing 110. The slot is provided with an opening 220 at the first end, and the opening 220 faces the side away from the bottom casing 110. In the first direction, the length from the first end to a grounding end of the antenna is ¼ of the operating wavelength (i.e. the wavelength corresponding to the operating frequency). The antenna structure also includes a feeding terminal, one end of the feeding terminal is connected to the feeding module on the main board of the device, and the other end of the feeding terminal spans/traverses the slot and is located between the first end and the grounding end and is close to the grounding end, so as to radiate electromagnetic wave signals outward through the slot. It should be noted that, taking the slot at a lower part as an example, although FIG. 1B shows that the opening 220 is provided at a position corresponding to 4 o'clock indicated by the hour hand of the watch, those skilled in the art should understand that this illustration is merely an example. In fact, the position of the opening 220 can be flexibly arranged according to the application scenario and specific requirements, for example, it can also be placed at the position where the hour hand of the watch indicates 8 o'clock or others. Openings provided at different positions may have a certain influence on the circular polarization direction of the antenna, making the openings more favorable to receive GPS circular polarization signals from satellites. Similarly, the above description can also be applied to the slot at an upper part in FIG. 1B, which will not be repeated here.

It can be seen from the above that the antenna structure according to the implementation of the present disclosure uses a slot antenna to realize the antenna structure for an all-metal casing, which is applicable for wearable devices with a metal casing, and improves the device strength and appearance integrity of the device. The slot antenna is arranged in the side frame 120 to prevent the antenna signal from being blocked (e.g., shielded) when the device is worn, thereby improving the signal strength. By providing the opening at the first end, the feeding terminal and the slot in the antenna structure form a slot antenna with a physical length being ¼ of the operating wavelength, that is, the length of the slot in the first direction is shortened to ¼ of the operating wavelength. As a result, the length of the slot can be reduced by half, and the length of the opening of the slot can be reduced, such that the metal appearance can be preserved to the greatest extent. And a smaller slot is also convenient to improve the dustproof and waterproof level of the device, and meanwhile meets the requirements of miniaturized wearable devices.

Figure 2:
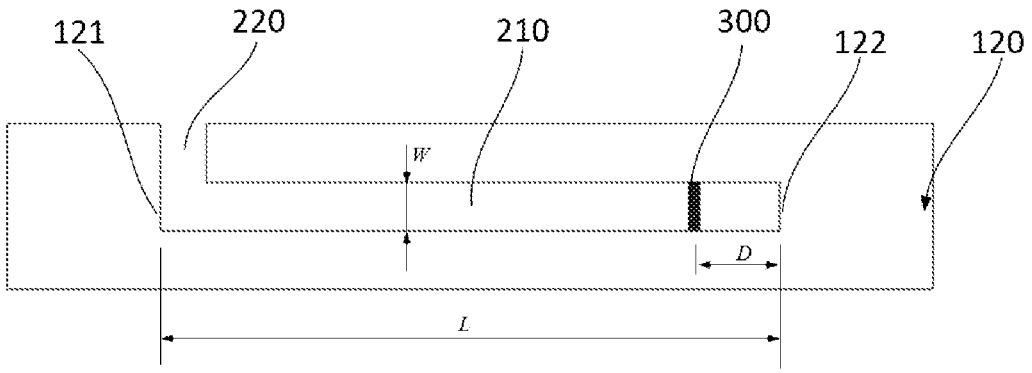
FIG. 2 is a schematic diagram of an antenna structure according to some implementations of the present disclosure.

A specific implementation of the antenna structure according to the present disclosure is shown in FIG. 2, and the antenna structure of the present disclosure will be described in detail below with reference to FIG. 2.

For the convenience of description, the direction in which the side frame 120 surrounds the edge of the bottom casing 110 is defined as a "first direction". It can be understood that the "first direction" refers to the direction surrounding the surface of the side frame 120. For example, if the side frame 120 surrounds as a circle, "the first direction" refers to the surrounding direction of the circle, and "a length in the first direction" is the length of an arc; if the side frame 120 is a rounded rectangular structure shown in FIG. 1B, the "first direction" refers to the direction surrounding the rounded rectangle, and "a length in the first direction" is the perimeter of the rounded rectangle. In the implementation shown in FIG. 2, the left-right direction in FIG. 2 is the first direction corresponding to the side frame 120.

As shown in FIG. 2, in this implementation, the antenna structure includes a slot 210 in the side frame 120, and the slot 210 has a first end 121 and a second end 122 opposite to the first end 121 in the first direction. The slot 210 refers to a through-hole penetrating through the side wall of the side frame 120. The first end 121 of the slot 210 is provided with an opening 220, and the opening 220 refers to a gap that leaves one end of the slot 210 open. The opening 220 also needs to penetrate through the side wall of the side frame 120, and the open direction of the opening 220 faces the side away from the bottom casing 110, that is, towards the upward direction in FIG. 2. The structure formed by the opening 220 and the slot 210 is shown in FIG. 2.

The feeding module is arranged on the main board inside the casing 100, and the feeding module is used to excite electromagnetic waves with different resonance frequencies, and the electromagnetic waves are radiated outward through the slot antenna formed by the feeding terminal 300 and the slot 210. The basic principles of the antenna are well known to those skilled in the art, and will not be repeated in the present disclosure. The feeding terminal 300 spans/traverses the slot 210 in a width direction, that is, the vertical direction in FIG. 2. As shown in FIG. 2, the feeding terminal 300 is disposed between the first end 121 and the second end 122 in the longitudinal direction of the slot 210 and is near to the second end 122.

Based on the principle of the slot antenna, it can be seen that, providing a feeding terminal at the middle of grounding points at two ends of a slot is equivalent to forming a dipole antenna with ½ wavelength, and the physical length of the slot is ½ of the operating wavelength of the antenna. However, in this implementation, the opening 220 is provided at the first end 121 of the slot 210, the slot 210 with the opening 220 and the feeding terminal 300 together form a monopole antenna with ¼ wavelength, and the physical length L of the slot 210 is ¼ of the operating wavelength of the antenna. For an antenna with the same function, the physical length L of the slot 210 can be reduced by half using the antenna structure of this implementation. The antenna structure of this implementation is suitable for relatively small-sized wearable devices, such as smart wristbands, smart earphones, and the like.

Specifically, the length L of the slot 210 in the first direction should be equal to ¼ wavelength of the radiated electromagnetic wave. If the functions achieved by the antenna structure are different, the wave bands emitted by the antenna are different. For example, the central operating frequency of the Bluetooth® antenna is 2.44 GHz, while the central operating frequency of the civil GPS satellite positioning antenna is generally 1.575 GHz, so the length L of the slot 210 can be calculated according to different resonance frequencies. The relationship between the length L of the slot 210 and the operating frequency $f$ of the electromagnetic wave emitted by the slot antenna is expressed as:

$$L = \frac{1}{4}\lambda = \frac{C}{4f} \tag{1}$$

In formula (1), L represents the length of the slot 210 in the first direction, λ represents the wavelength of the electromagnetic wave, C represents the speed of light, and f represents the resonance frequency of the electromagnetic wave. It can be seen from equation (1) that the length L of the slot 210 is inversely proportional to the operating frequency $f$ of the antenna, that is, a lower operating frequency of the antenna requires a longer slot length.

As can be seen from the above, if the device includes two or more antenna structures with different operating frequencies, the lengths of the slots 210 in the side frame 120 are different, which makes the device unable to achieve a symmetrical structure in appearance. With the development of electronic devices, appearance has been an important consideration for people to choose electronic devices. Therefore, the present disclosure further provides some implementations that can further ensure the consistency of the appearance of the device while reducing the length of the slot.

For convenience of description, a Bluetooth antenna and a satellite positioning antenna are used as examples for description. The central operating frequency of the Bluetooth antenna is 2.44 GHz, and the central operating frequency of the civil GPS satellite positioning antenna is generally 1.575 GHz. Using the formula (1), a relationship between slot length $L_1$ of the Bluetooth antenna and slot length $L_2$ of the satellite positioning antenna can be calculated, and expressed as:

$$L_1 = \frac{1.575}{2.44}L_2 = 0.65L_2 \tag{2}$$

It can be known from formula (2) that, the slot length of the Bluetooth antenna is about 0.65 times of the slot length of the GPS satellite positioning antenna. In other words, if two slots are provided at opposite sides of the casing, the length difference of the two slots is relatively large. Asymmetric slots can lead to a cluttered appearance of the device, which brings a bad feeling for appearance and greatly reduces the class of the device.

In this implementation, the structure of the satellite positioning antenna is shown in FIG. 2, wherein the physical length L from the first end 121 to the second end 122 of the slot 210 may be the slot length $L_2$ of the satellite positioning antenna. In the design of the Bluetooth antenna, referring to FIG. 3A, the length from the first end 121 to the second end 122 of the slot 210 is still $L_2$, which is consistent with the satellite positioning antenna. However, in the Bluetooth antenna, an additional grounding end 400 is further included. The additional grounding end 400 is arranged in the slot 210 between the first end 121 and the second end 122. The additional grounding end 400 spans the width of the slot 210, thereby the slot 210 is divided into two sub-slots on the left and right sides in the length direction.

The feeding terminal 300 is disposed between the first end 121 and the additional grounding end 400 and is close to the additional grounding end 400. The function of the additional grounding end 400 is equivalent to moving the grounding end of the slot antenna to the position where the additional grounding end 400 is located. In this way, by changing the position of the additional grounding end 400 in the first direction of the slot 210, the antenna can be adjusted to be suitable for generating different operating frequencies.

Figure 3A:
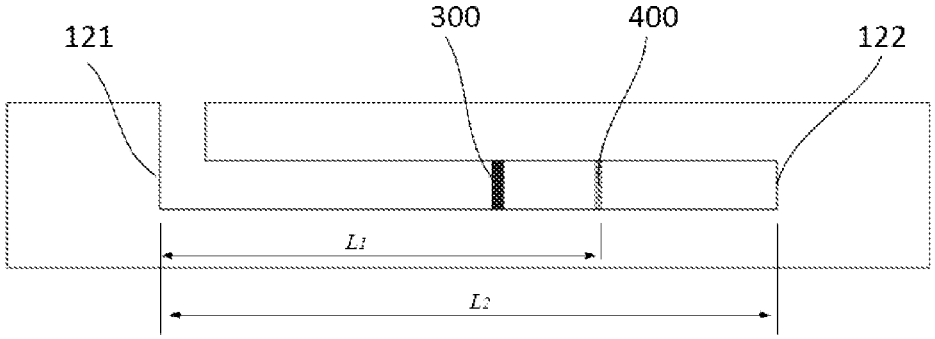
FIG. 3A is a schematic diagram of an antenna structure according to some implementations of the present disclosure.
Figure 3B:
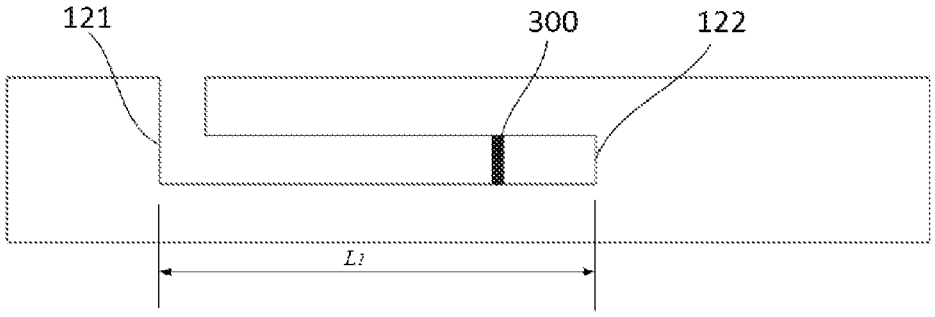
FIG. 3B is a schematic diagram of an antenna structure equivalent to the antenna structure shown in FIG. 3A.

As shown in FIG. 3A, in this implementation, the distance from the first end 121 to the additional grounding end 400 is set as $L_1$=0.65$L_2$. The length from the first end 121 to the additional grounding end 400 is equivalent to ¼ of the operating wavelength of the Bluetooth antenna, so as to realize the radiation of the Bluetooth signal. The implementation in FIG. 3A is equivalent to an antenna structure in FIG. 3B.

In this implementation, by adjusting the position of the additional grounding end 400 in the slot 210, antenna structures with different operating wavelengths can be realized, so that antennas with different functions can be realized without changing the opening length of the slot 210. For example, if the device includes a Bluetooth antenna and a satellite positioning antenna, the two antennas are respectively provided in opposite sides of the device, and the two slots of the two antennas are provided symmetrically. The additional grounding end 400 is used to adjust effective electrical length of the slot antenna for realizing the Bluetooth function, thereby effectively improving uniformity and symmetry of the device in appearance.

Of course, those skilled in the art can understand that the antenna structure provided by the present disclosure is not limited to the above two examples, and the antenna of the device is not limited to include only the above two examples, but also be any other form suitable for implementation, which will not be enumerated. In addition, in the case of low requirements on the consistency and symmetry of the appearance of the device, different antenna functions can be directly realized by providing slots of different lengths, which is also not limited in the present disclosure.

Further, referring to the antenna structures in FIG. 2 and FIG. 3A, it can be known that the antenna structure of the present disclosure has an opening 220 at the first end 121 of the slot 210 to form a slot antenna of ¼ of an operating wavelength similar to a monopole, so as to shorten the length of the slot 210. Referring to figures, it can be seen that the structure of the opening 220 makes the entire antenna structure asymmetric in the first direction, which also affects the consistency of the appearance of the device. Therefore, the present disclosure provides other implementations to further improve the uniformity and symmetry of the appearance of the device on the basis of the above structure.

Figure 4A:
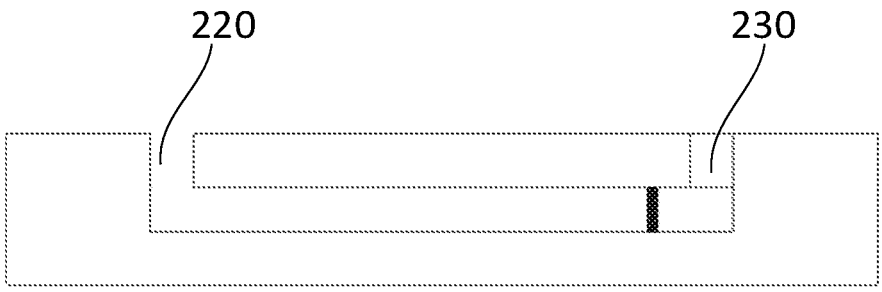
FIG. 4A is a schematic side view of an antenna structure according to some implementations of the present disclosure.
Figure 4B:
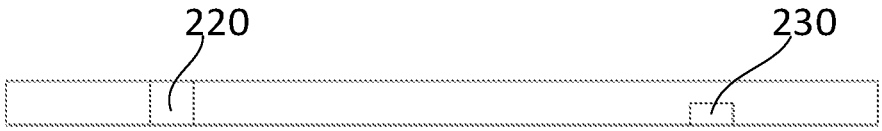
FIG. 4B is a top view of the antenna structure shown in FIG. 4A.

As shown in FIG. 4A, in some implementations, a groove 230 is formed in the outer sidewall of the second end 122 of the slot 210. As shown in FIG. 4A, the groove 230 and the opening 220 have the same shape on the surface of the outer side wall, but as shown in FIG. 4B (FIG. 4B is a top view of the antenna structure shown in FIG. 4A), the groove 230 is provided on the surface of the side frame 120, and does not penetrate the side frame 120 in the thickness direction. In this way, after the slot is filled, it can be seen from the appearance that the slot 210 is a completely symmetrical structure in the first direction, and the groove 230 is a non-penetrating groove, which does not change the length and opening distribution of the slot 210, thereby not affecting performance of the original antenna structure.

After the antenna structure is formed, the slot needs to be filled by injection molding. For example, nano-injection can be used to fill the slot with non-metallic nanomaterials. Sealing the slot, on one hand, can improve the dustproof and waterproof degree of the overall device, and on the other hand, since the wavelength of the radiated electromagnetic signal is shortened when the radiated electromagnetic signal propagates in the material, the filling medium can also be used to further reduce the length of the slot.

Figure 5A:
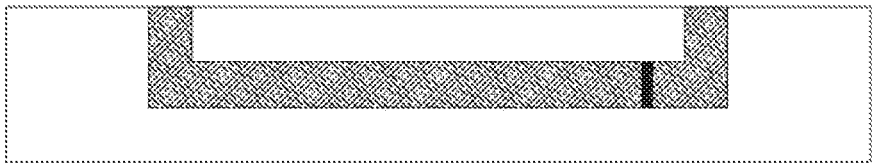
FIG. 5A is a schematic side view of a filling structure according to some implementations of the present disclosure.
Figure 5B:
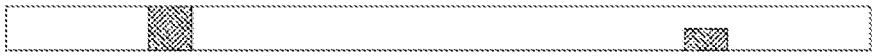
FIG. 5B is a top view of the filling structure shown in FIG. 5A.

Taking the implementation shown in FIGS. 4A and 4B as an example, the appearance after filling with nanomaterials can be as shown in FIG. 5. It can be seen that in the first direction, the shape of the slot is completely symmetrical, and the appearance of the casing has better consistency. Of course, those skilled in the art can understand that in a case that the consistency and symmetry of the appearance of the device are not highly required, the groove 230 is not necessary, and whether to provide the groove or not is not limited in the present disclosure.

In addition, the wavelength of the electromagnetic wave in the medium decreases with the increase of the dielectric constant, so the length of the slot can be further reduced by using a filling material with a high dielectric constant. However, a medium with an excessively large dielectric constant will reduce the bandwidth and radiation efficiency of the antenna. Therefore, in an example of the present implementation, the filler material has a dielectric constant of about 3.0. Taking a satellite positioning antenna with an operating frequency of 1.575 GHz as an example, in this implementation, the length of the slot can be controlled to be about 33 mm, which can greatly shorten the length of the slot.

It can be seen from the above implementations that the antenna structure of the present disclosure can be applied to wearable devices with metal casings. By providing an opening at one end of the slot, the feeding terminal and the slot form a slot antenna of ¼ of an operating wavelength, which greatly shortens the length of the slot. Moreover, by arranging an additional ground terminal, antennas with different functions can be realized without changing the length of the slot. Further, by configuring a non-penetrating groove at the other end, the antenna structure can be symmetrical in the first direction, so as to make the appearance consistency of the entire device better.

Figure 8:
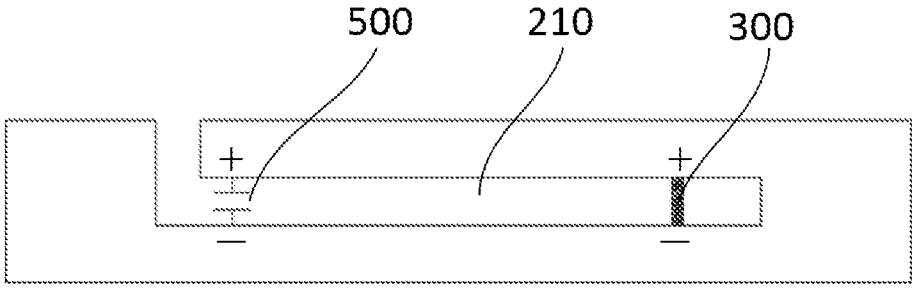
FIG. 8 is a schematic diagram of an antenna structure according to some implementations of the present disclosure.

Further, FIG. 8 shows antenna structures in some other implementations of the present disclosure. In the present implementation, by providing a capacitor in the slot, the effective electrical length of the slot antenna is extended. In this way, at the same resonant frequency, the physical length of the slot can be further shortened. A specific description will be given below with reference to FIG. 8.

As shown in FIG. 8, in this implementation, the antenna structure further includes a first capacitor 500, and the first capacitor 500 is connected across the slot 210, that is, the two poles of the first capacitor 500 are electrically connected to two sides of the slot 210 in the width direction.

As mentioned in the above implementations of the present disclosure, the feeding terminal 300 or the first capacitor 500 is provided in the slot 210. For example, the first capacitor 500 and the feeding terminal 300 are connected across two sides of the slot in the width direction. As shown in FIG. 8, a positive (+) pole of the feeding terminal 300 and a positive (+) pole of the first capacitor 500 are connected at the upper part of the slot, and a negative (−) pole of the feed terminal 300 and a negative (−) pole of the first capacitor 500 are connected at the lower part of the slot. In actual operation, the lower part of the slot 210 and the PCB board of the device system are electrically connected to each other through a screw on the PCB board and the metal casing. The feeding terminal 300 can be realized by a 50 ohms transmission line or a tab. If a 50 ohms transmission line is used to feed the slot antenna, the core of the transmission line (i.e. the positive pole) is connected to the upper side of the slot 210, and an outer conductor of the transmission line (i.e. the negative pole) can be directly connected to a ground of the PCB board. If the tab is used to feed the slot antenna, the core of the tab abuts (connects) to the upper part of the slot 210, and a ground of the tab can be directly welded to a ground of the PCB board. The upper side of the slot can be drawn out through the tab to an independent pad on the PCB board, the positive pole of the first capacitor 500 can be welded on the independent pad, and the negative pole of the capacitor can be connected to the ground of the PCB board, such that the positive pole of the first capacitor 500 is connected to the upper part of the slot 210, and the negative pole is grounded. As long as the capacitor and the feeding terminal can be successfully applied to both sides of the slot in the width direction, any method that can be adopted by those skilled in the art falls within the protection scope of the present disclosure, and details are not described herein repeatedly.

The physical principle of resonance generated by the slot antenna is similar to the resonance circuit. Configuring a crossing capacitor in the slot antenna is equivalent to increasing the capacitance value of the resonance circuit, thereby reducing the resonance frequency accordingly. The reduction of the resonant frequency is equivalent to extending the effective electrical length of the slot antenna. For the same resonant frequency, the length of the slot of the antenna structure with a capacitor can be shorter.

According to the operating principle of the capacitor, if the difference between voltages applied to the two poles of the capacitor is larger, the frequency reduction produced by the capacitor is stronger. Accordingly, it can be known that, if the first capacitor 500 is at a position with a larger voltage value at the antenna resonant frequency, the degree of the shift of the antenna resonant frequency to the lower frequency is larger, that is, the effective electrical length of the antenna is extended to a larger value.

For the slot antenna of ¼ wavelength in this implementation, the voltage distribution at the resonant frequency shows that the voltage value gradually decreases along the length direction from the first end 121 to the second end 122 of the slot. The voltage value at the opening 220 at the first end 121 is the largest, and the voltage value at the grounding end is zero. Therefore, in the first direction, if the position of the first capacitor 500 is closer to the opening 220 or to the first end 121, frequency reduction effect of the capacitor is better, and the amount of the shifting of the antenna resonant frequency to the lower frequency is larger, such that the effective electrical length of the antenna can be extended to a greater extent. That is, for a same resonant frequency, if the first capacitor 500 is disposed closer to the opening end of the slot and farther away from the grounding end, the reduction of length of the slot is larger.

Different capacitance values also have impacts on antenna performance. According to the operating principle of the capacitor, if the capacitance value of the applied first capacitor 500 is larger, the effect of shifting the resonant frequency of the antenna to the lower frequency is better, and the effective electrical length of the antenna is extended more. However, the capacitance value is inversely proportional to the efficiency of the antenna. In other words, considering the efficiency of the antenna, the capacitance value should be as small as possible to ensure the performance of the antenna. Therefore, the resonant frequency of the antenna can be fine-tuned by changing the capacitance value, so as to achieve a balance between reducing the length of the slot and ensuring the performance of the antenna.

In this implementation, by configuring the capacitor in the slot antenna, the effective electrical length of the slot antenna can be extended under the same length of the slot, and the operating frequency of the antenna can be reduced. In the case of realizing the same operating frequency, by arranging the capacitor in the slot of the antenna structure, the length of the slot can be reduced. Based on the understanding of this implementation, those skilled in the art can infer without creative work that the structure of the slot antenna with the capacitor is not limited to that shown in FIG. 8, and applying a capacitor on the basis of any of the foregoing implementations can achieve above-mentioned effects.

In a second aspect, an implementation of the present disclosure provides a wearable device, where the wearable device includes the antenna structure in any of the foregoing implementations. The wearable device described in the present disclosure can be any type of device suitable for implementation, such as wrist-worn devices (e.g. smart watches or smart wristbands), head-mounted devices (e.g. smart earphones or smart glasses), or worn devices (e.g. smart clothing).

Taking the wearable device being a smart watch as an example, the smart watch is a watch with a metal casing, and the structure of the casing is shown in the implementations shown in FIGS. 1A and 1B. A main board (not shown in the drawings) is arranged inside the casing, the main board includes a feeding circuit, and the feeding terminal of the antenna structure is connected to the feeding circuit of the main board. The smart watch may include a Bluetooth® antenna and a satellite positioning antenna, and the satellite positioning antenna may be, for example, a GPS satellite positioning antenna, a Beidou satellite positioning antenna, or the like, which can be understood by those skilled in the art and will not be described in detail.

As shown in FIG. 1A, the Bluetooth antenna 201 and the satellite positioning antenna 202 are symmetrically arranged in the side frame 120 on opposite sides of the casing. The Bluetooth antenna 201 and the satellite positioning antenna 202 adopt a completely symmetrical structure as in the above implementations, that is, the additional grounding end 400 is used to realize that the length of the first slot of the Bluetooth antenna 201 and the length of the second slot of the satellite positioning antenna 202 are the same. It can be seen that, from the appearance of the casing, the two antennas provided on opposite sides and each having a symmetrical structure, makes the appearance of the device more integrated. Moreover, it is not necessary to provide an annular slot on the casing, which greatly reduces the length of the slot on the side frame, making the overall structural strength and waterproof level of the watch higher.

It can be understood that the above implementations are used to merely illustrate the present disclosure, but not limit the solutions of the present disclosure. In other implementations, the number of antennas of the watch can also be any other number suitable for implementation. For example, a satellite positioning antenna can be provided in the device casing, and the Bluetooth antenna can be provided inside. For another example, if the volume of the device allows, in addition to a satellite positioning antenna and a Bluetooth antenna, the device may also include a WIFI antenna, an LTE antenna, a 5G (5th Generation Mobile Communication Technology, abbreviated to 5G) antenna, or the like. The wearable device may be other type of device, such as earphone, smart wristband, or the like. Moreover, the shape of the casing of the wearable device is not limited to the above-mentioned rectangular structure, and can be any other shape suitable for implementation, such as a circle or the like.

Figure 6:
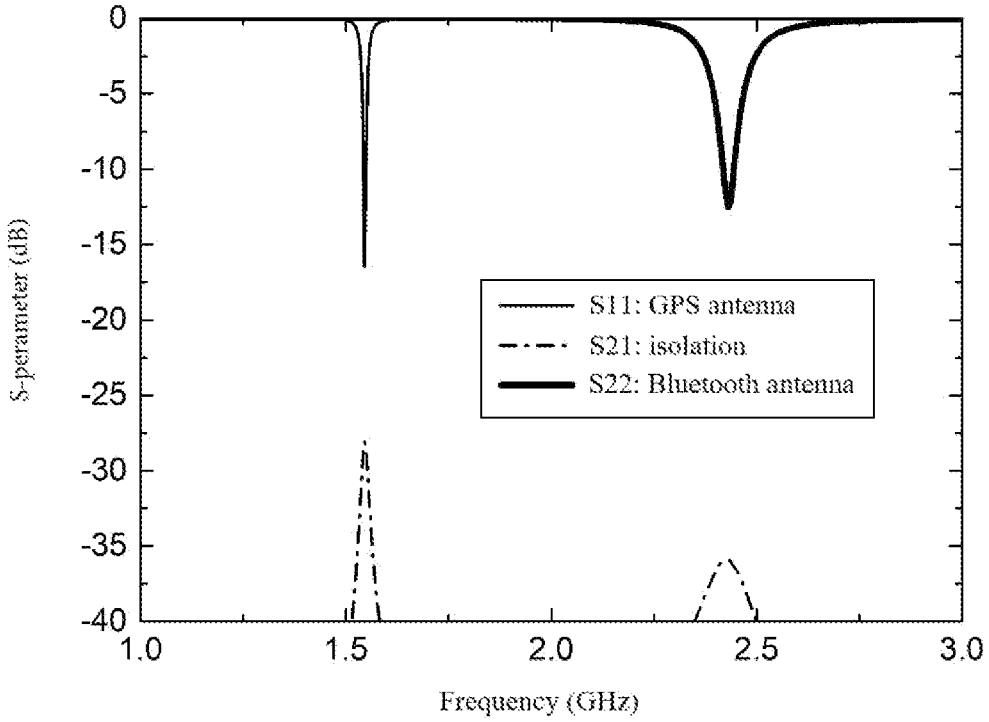
FIG. 6 is a graph of antenna's return loss for an antenna structure according to some implementations of the present disclosure.

In the implementations shown in FIG. 1B and FIG. 2, it takes the typical value of the slot width W of the two antennas being 1.2 mm, and the ratio of the length D, from the feeding terminal 300 to the grounding end, to the entire slot length L being 0.1 to 0.2, as an example. For the watch of this implementation, FIG. 6 shows a return loss curve of the satellite positioning antenna S11, a return loss curve of the Bluetooth antenna S22, and an isolation degree curve S21 between the two antennas. It can be seen from the results in FIG. 6 that, in this implementation, the satellite positioning antenna and the Bluetooth antenna not only have good return loss, but also have high isolation degree between the two antennas.

Figure 7:
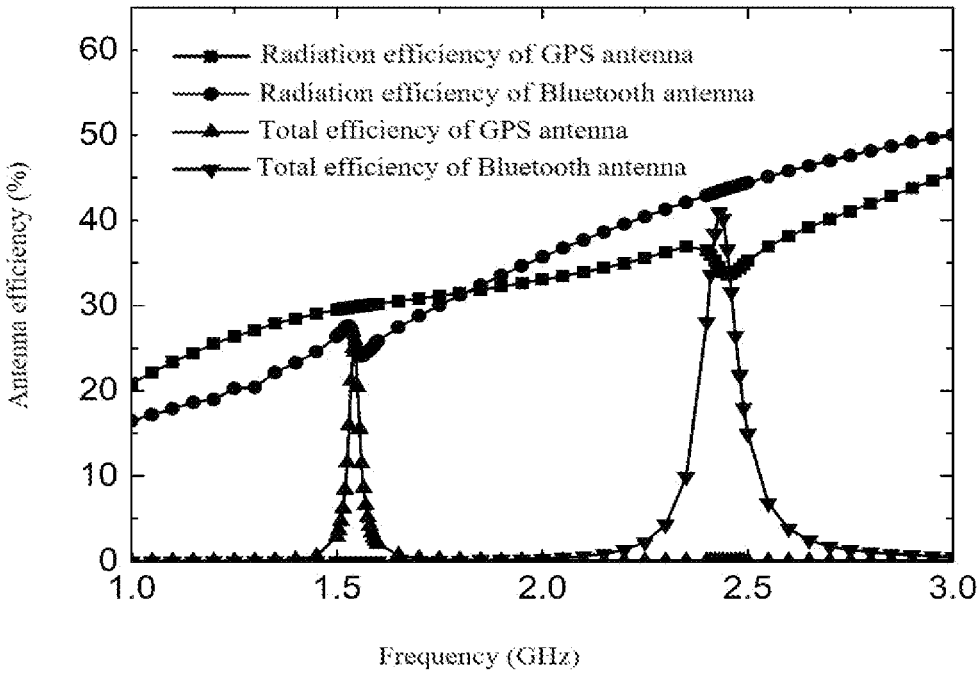
FIG. 7 is a graph of antenna efficiency of an antenna structure according to some implementations of the present disclosure.

For the watch of this implementation, FIG. 7 shows a radiation efficiency curve of the satellite positioning antenna, a radiation efficiency curve of the Bluetooth antenna, a total efficiency curve of the satellite positioning antenna, and a total efficiency curve of the Bluetooth antenna. It can be seen that the antenna structure in this implementation has high radiation efficiency and total efficiency, and has good antenna performance.

It can be seen from the above that, the implementation of the present disclosure provides a wearable device with the all-metal casing, which has higher structural strength, better appearance and smaller antenna slot, such that the integration and appearance of the device are better, the wearable device has a good appearance, and user experience is better.

The above-mentioned implementations are merely examples for describing more clearly, and are not intended to limit the disclosure. For those of ordinary skill in the art, changes or modifications in other different forms can be made on the basis of the above description. For example, the position of the slot is not in top of the metal middle frame, but in the bottom casing or at other position, as long as an opening is provided at the end of the slot away from the feeding terminal to form a slot antenna of ¼ of the operating wavelength. In addition, by properly adjusting the length of the slot, the position of the feeding terminal, the position of the grounding end and the position of the capacitor, the above slot serving as a Bluetooth antenna can be transformed into a slot that supports both Bluetooth antenna operating at the frequency of 2.4 GHz and GPS L5 antenna operating at the frequency of 1.176 GHz. In this way, the device supports dual-frequency GPS, thereby improving the positioning function of the device. The operating frequency of the GPS positioning antenna includes two different frequency bands: a basic frequency band L1 with the operating frequency of 1.575 GHz and an auxiliary frequency band L5 with the operating frequency of 1.176 GHz, and if the auxiliary frequency band is added on the basis of the basic frequency band, positioning accuracy can be further improved. There is no need and impossible to exhaustively enumerate all implementations herein, however, the obvious changes or modifications derived from the above implementation are still within the protection scope of the present disclosure.

What is claimed is:

1. An antenna structure applicable to a wearable device, wherein the wearable device comprises a metal casing, the metal casing comprises a bottom casing and a side frame surrounding an edge of the bottom casing and integrally connected with the bottom casing, and the antenna structure comprises:

a slot in the side frame, wherein the slot has a first end and a second end in a first direction, the first direction is a direction around the edge of the bottom casing;

the slot is provided with an opening at the first end, and the opening faces a side away from the bottom casing; and in the first direction, a length from the first end of the slot to a grounding end is ¼ of an operating wavelength of the antenna structure; and a feeding terminal arranged in the slot and located between the first end of the slot and the grounding end and near to the grounding end in the first direction.

2. The antenna structure according to claim 1, wherein a groove is formed on an outer sidewall of the second end of the slot, and the groove and the opening have a same shape on a surface of the outer sidewall.

3. The antenna structure according to claim 2, wherein the groove is a non-penetrating groove.

4. The antenna structure according to claim 1, wherein the slot is filled with an injection-molded structure that matches in shape, and the injection-molded structure is a non-metallic material.

5. The antenna structure according to claim 1, further comprising:

a first capacitor, disposed in the slot and located between the first end and the grounding end in the first direction, and two poles of the first capacitor are respectively connected to two sides of the slot in a width direction.

6. The antenna structure according to claim 5, wherein the first capacitor is close to the first end in the first direction.

7. The antenna structure according to claim 1, wherein in the first direction, a distance between the feeding terminal and the grounding end is a first length, a distance between the first end and the grounding end is a second length, and a ratio of the first length to the second length is 0.1 to 0.2.

8. The antenna structure according to claim 1, wherein the second end of the slot forms the grounding end.

9. The antenna structure according to claim 1, further comprising:

an additional grounding end disposed in the slot and located between the first end and the second end in the first direction, wherein the additional grounding end separates the slot in the first direction into a first sub-slot and a second sub-slot, and the additional grounding end forms the grounding end.

10. A wearable device, comprising:

at least one antenna, wherein each of the at least one antenna includes the antenna structure according to claim 1.

11. The wearable device of claim 10, wherein the at least one antenna comprises:

a first antenna and a second antenna, wherein, the first antenna and the second antenna are respectively disposed on opposite sides of the side frame; and a first slot in the first antenna and a second slot in the second antenna are symmetrical in shape.

12. The wearable device according to claim 11, wherein a grounding end of the first antenna is formed by an additional grounding end;

and a grounding end of the second antenna is formed by the second end.

13. The wearable device according to claim 12, wherein a length from the first end to the grounding end of the first antenna is ¼ of an operating wavelength of a Bluetooth antenna, and a length from the first end to the grounding end of the second antenna is ¼ of an operating wavelength of a satellite positioning antenna.

14. The wearable device according to claim 10, wherein the wearable device is a smart watch or a smart wristband.

15. The wearable device according to claim 12, wherein the antenna structure further comprises:

the additional grounding end disposed in the slot and located between the first end and the second end in the first direction, wherein the additional grounding end separates the slot in the first direction into a first sub-slot and a second sub-slot, and the additional grounding end forms the grounding end.

16. The wearable device according to claim 10, wherein a groove is formed on an outer sidewall of the second end of the slot, and the groove and the opening have a same shape on a surface of the outer sidewall.

17. The wearable device according to claim 16, wherein the groove is a non-penetrating groove.

18. The wearable device according to claim 10, wherein the slot is filled with an injection-molded structure that matches in shape, and the injection-molded structure is a non-metallic material.

19. The wearable device according to claim 10, wherein the antenna structure further comprises:

a first capacitor, disposed in the slot and located between the first end and the grounding end in the first direction, and two poles of the first capacitor are respectively connected to two sides of the slot in a width direction.

20. The wearable device according to claim 19, wherein the first capacitor is close to the first end in the first direction.

* * * * *